US007117537B2

(12) United States Patent
Mazzarolo

(10) Patent No.: US 7,117,537 B2
(45) Date of Patent: Oct. 10, 2006

(54) SPORTS GARMENT HAVING SLIP RESISTANT SURFACE ZONES

(75) Inventor: Gabriele Mazzarolo, Coste di Maser (IT)

(73) Assignee: Alpinestars Research SRL, Treviso (IT)

( * ) Notice: Subject to any disclaimer, the term of this patent is extended or adjusted under 35 U.S.C. 154(b) by 169 days.

(21) Appl. No.: 10/399,347

(22) PCT Filed: Aug. 21, 2001

(86) PCT No.: PCT/IT01/00445

§ 371 (c)(1),
(2), (4) Date: Apr. 15, 2003

(87) PCT Pub. No.: WO03/015549

PCT Pub. Date: Feb. 27, 2003

(65) Prior Publication Data

US 2004/0025217 A1 Feb. 12, 2004

(51) Int. Cl.
*A41D 13/00* (2006.01)

(52) U.S. Cl. ..... 2/69

(58) Field of Classification Search ..... 2/22, 2/24, 79, 227, 69, 455, 267, 62, 242
See application file for complete search history.

(56) References Cited

U.S. PATENT DOCUMENTS 3,086,214 A 4/1963 Lash
3,329,966 A 7/1967 Slavick
4,608,716 A 9/1986 Brumfield
4,700,407 A * 10/1987 Mattila ..... 2/465
4,810,559 A * 3/1989 Fortier et al. ..... 428/161
4,841,577 A 6/1989 Lars-Jos
4,845,778 A 7/1989 Peterson
4,946,453 A 8/1990 Monson
5,052,052 A * 10/1991 Gilford et al. ..... 2/467
5,109,546 A 5/1992 Dicker
5,201,074 A 4/1993 Dicker
5,282,277 A 2/1994 Onozawa
5,295,267 A * 3/1994 Galindo ..... 2/466
5,337,418 A * 8/1994 Kato et al. ..... 2/456
5,367,708 A 11/1994 Fujimoto
5,652,957 A 8/1997 Williford et al.
5,768,703 A 6/1998 Machado et al.
5,845,335 A 12/1998 Twitty
5,845,336 A * 12/1998 Golde ..... 2/93
5,898,934 A 5/1999 Hunter et al.
5,960,474 A 10/1999 Dicker et al.
5,978,966 A 11/1999 Dicker et al.
6,186,970 B1 2/2001 Fujii et al.
6,260,196 B1 * 7/2001 van der Sleesen ..... 2/2.5
6,279,161 B1 8/2001 Johnston
D481,523 S 11/2003 Hujii et al.
6,708,342 B1 * 3/2004 Boersema ..... 2/69
6,817,029 B1 11/2004 Mazzarolo
2001/0014981 A1 8/2001 Fairhurst et al.

FOREIGN PATENT DOCUMENTS

DE 30 33 059 4/1982

(Continued)

*Primary Examiner*—Tejash Patel
(74) *Attorney, Agent, or Firm*—Katten Muchin Rosenman LLP

(57) ABSTRACT

Sports dress, in particular for motor-cyclists, characterized in that, in correspondence of parts of the body of the wearer which, under use conditions, are in touch with or, at least, graze parts of the motor-cycle, on the outer surface thereof there are provided zones (40, 42, 44, 46, 48) that are fabricated with slip-resistant materials.

11 Claims, 1 Drawing Sheet

FOREIGN PATENT DOCUMENTS

| | | | |
|---|---|---|---|
| DE | 37 31 878 | A | 1/1989 |
| DE | 199 20 562 | A | 11/2000 |
| DE | 100 17 792 | | 10/2001 |
| EP | 0 118 898 | A | 9/1984 |
| EP | 0 950 360 | | 10/1999 |
| FR | 2 449 415 | | 9/1980 |
| FR | 2 665 060 | | 1/1992 |
| GB | 171258 | | 11/1921 |
| GB | 2 043 430 | | 10/1980 |
| WO | WO 01 10254 | A | 2/2001 |

* cited by examiner

SPORTS GARMENT HAVING SLIP RESISTANT SURFACE ZONES

DESCRIPTION

The present invention refers to an article of sportswear, in particular a motorcyclist dress.

The state of the art in the field of sportswear for motor-cyclists and the like is mainly focused on the general goal of ensuring the best possible protection of the wearer's body against both the environmental conditions (air, rain, cold, and the like) and the effects of possible falls occurring when racing or travelling at high speed. This can be inferred not only from the kind of dresses that are currently sold on the market, but also from the disclosures in the technical literature—see for example the patent applications WOA-90 03126 and WOA-99 00030.

What has on the contrary been largely underestimated hitherto is the importance for a motor-cyclist to be able to avail himself dresses that are adapted to remain as far as possible adhering to the motor-cycle when, above all during sports races at very high speed, the driver takes a so-called stream-lined position. Possible vortices brought about by air flows in the zones in which the body of the driver is close to, but not quite in touch with the motor-cycle may in fact give rise to unbalances in the drag which may impair the wearer safety.

The state of art which appears to fall closest to the object of the present invention consists, to the best knowledge of the Applicant, in the habit developed by some sport motor-cyclists to apply strips of sandpaper onto some surface zones of the motorcycle, eg. of the fuel tank, to the purpose of braking the sliding tendency of the parts of said dresses that come into contact with said surface zones when manoeuvring, eg. when the body of the driver is stooped into a so-called stream-lined position and/or bent when taking a curve.

It is therefore a main purpose of the present invention to provide a dress for motor-cyclists which is capable of meeting also the above mentioned, hitherto underestimated requirements with means that not only are as much effective as they are simple, but also impose just a definitely marginal increase in manufacturing costs, so that they can be used throughout the product range and not only in the most sophisticated and expensive articles.

In view of reaching this and further aims, the invention provides a dress having the characteristics recited in the appended claims, as this can be more clearly and readily understood from the description that is given below by way of non-limiting example of a preferred, although not sole embodiment with reference to the accompanying drawing, in which:

Figure 2:
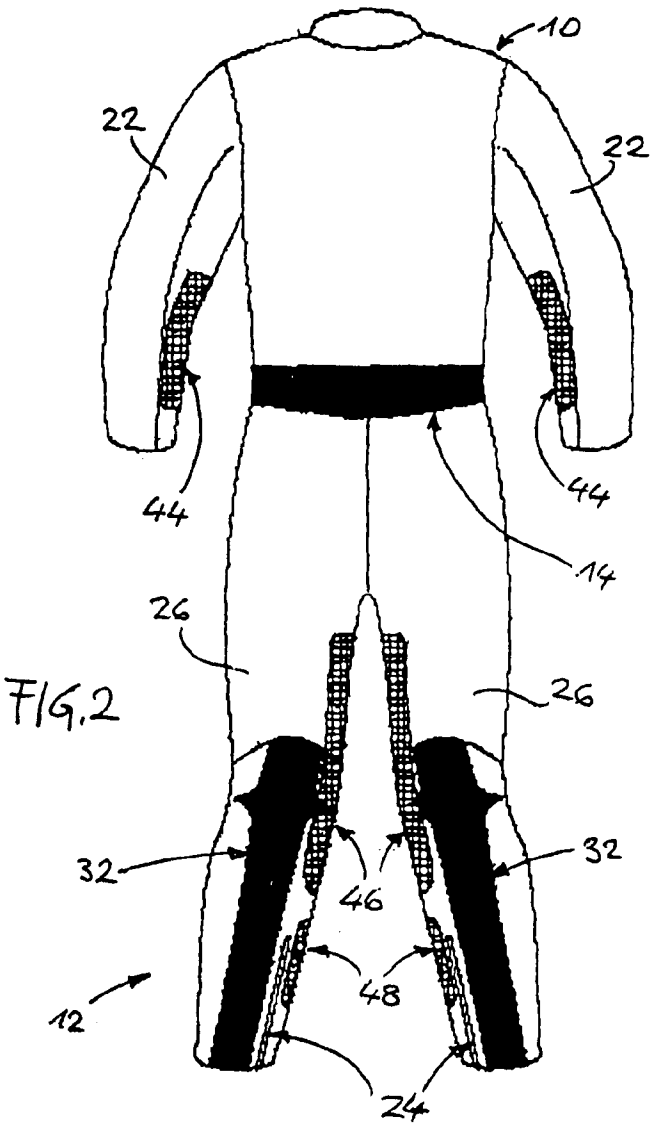
FIG. 2 is a rear view of the same suit.

The suit illustrated in the Figures comprises a jacket 10 and a pair of trousers 12 that are inseparably joined with each other by a band 14 of elastcised ribbon. In order to be capable of being put on, the suit is provided frontally with a central aperture 16 extending from the collar 18 down to almost the joining seam of the two legs 20 of the trousers 12, as well as an aperture 20 along each sleeve 22 of the jacket 10, close to the wrist zone thereof (see FIG. 1), and an aperture 24 in each one of the legs 26, close to the free end thereof (see FIG. 2). All these apertures 16, 20, 24 are adapted to be closed by means of, say, zip-fasteners or the like.

In a traditional manner, the suit has a composite structure which is comprised of an outer surface layer, impermeable to air and, preferably, also to water (eg. made of natural or synthetic skin), a padding layer and an inner lining.

Figure 1:
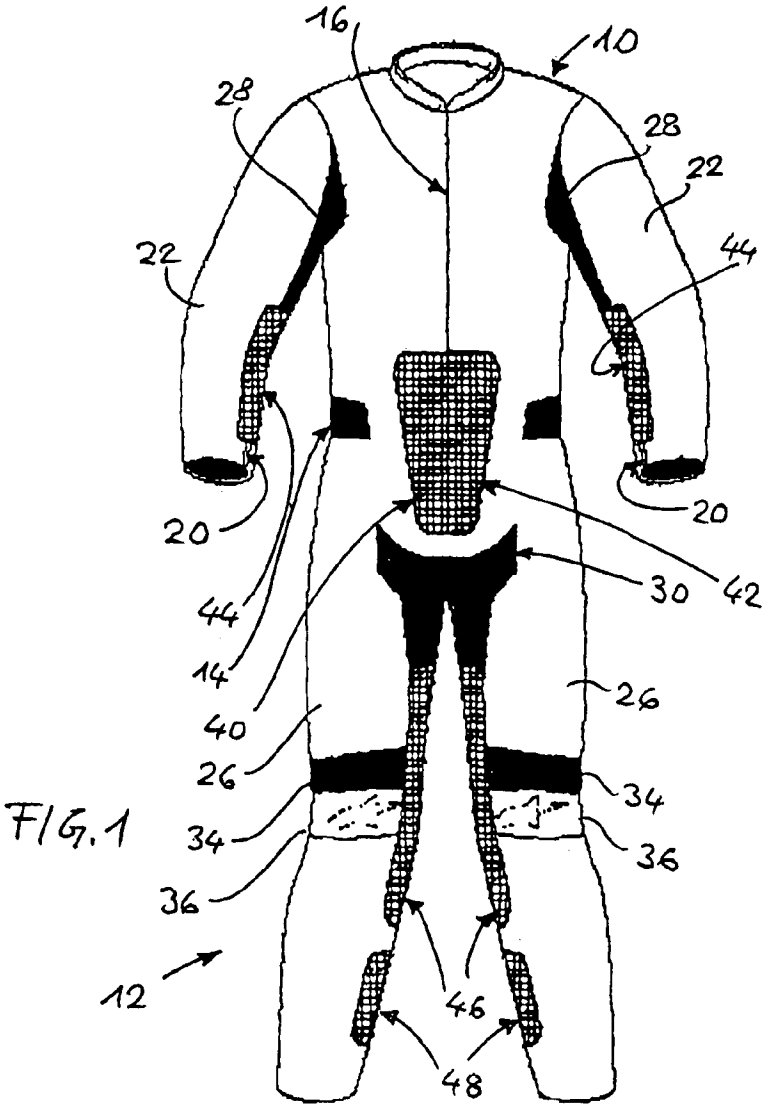
FIG. 1 is a front view of a suit according to the present invention.

Covered with a wear-resistant material there are furthermore some particular surface zones of the dress, and namely:

- the zones, generally indicated at 28, which extend on the front side of the sleeves 22 between the armpits and the elbows;
- the zone, generally indicated at 30, which lies between the inguinal portion of the trousers 12 and the upper portion of the legs 26;
- the zones, generally indicated at 34, which are situated above the knee-pads 36—see FIG. 1; and
- the zones, generally indicated at 32, which extend along the calves up to the knees—see FIG. 2.

According to the present invention, covered with a slip-resistant material there are finally some surface zones of the dress which, during use, come into contact with the body of the motorcycle, and namely:

- the zones, generally indicated at 40 and 42, which correspond to the abdomen and, possibly, also to the lowest ribs of the driver, on both the right side and the left side of the afore mentioned central aperture 16;
- the zones, generally indicated at 44, that extend along the sleeves 22 in correspondence of the forearms of the wearer, above the aperture 20;
- the zones, generally indicated at 46, which extend along the inner side of the legs starting from the already mentioned zone 30 of the suit which is abrasion-resistant down to well beyond the knee-pads 36;
- the zones, generally indicated at 48, which are situated along the inner side of the legs 26 in correspondence of the calves of the wearer.

As slip-resistant materials suitable for use in view of providing the above mentioned zones 40, 42, 44, 46 and 48 of the dress, there can be considered, for example, a slip-resistant elastomer, such as a nitrile rubber, possibly including such an abrasive as pumice in the mixture, strips of which are attached on to the desired zones of the outer surface layer of the suit by sewing, seaming, ultrasonic welding, bonding or any other of a number of per se known methods. As an alternative thereto, use can also be made of rubber strips featuring a particularly rough pattern or texture, or of a loop-and-hook material, for example, such as a VELCRO loop-and-hook material.

Quite obviously, the corresponding surface zones of the motor-cycle, eg. of the fuel tank or the frame thereof, may themselves be clad with similar materials or, anyway, with materials that are compatible with the ones used on the zones 40, 42, 44, 46 and 48 of the dress.

Although the above description refers to a dress, it will be appreciated that the present invention is to be understood as covering any single, albeit simpler garment such as a jacket or a pair of trousers.

It will be finally appreciated that the invention may be implemented according to embodiments differing from the above described one, without of course departing from the scope of the present invention as defined by the appended claims.

The invention claimed is:

1. A sports suit, in particular for motor-cyclists, comprising:

- a plurality of zones fabricated with slip-resistant and substantially high friction materials ensuring that selected portions on the outer surface of the dress in correspondence of parts of the body of the wearer which, under use conditions, are in touch with or, at least, graze parts of the motor-cycle, remain substantially adhering thereto, as to prevent the local formation of air vortices.

2. A sports jacket for motor-cyclists with a front central aperture, the sports jacket comprising:

a plurality of zones fabricated with slip-resistant and substantially high friction materials is are in correspondence of the abdomen and possibly also the lowest ribs of the wearer, on both the right side and the left side of said central aperture; the plurality of zones grazing parts of a motorcycle by adhering thereto by preventing local formation of air vortices.

3. A sports jacket for motor-cyclists according to claim 2, characterized in that zones fabricated with slip-resistant and substantially high friction materials are provided also in correspondence of the forearms, above the possibly provided aperture of the sleeve portions that can close in the wrist of the wearer.

4. A sports trousers for motor-cyclists, the sports trousers comprising:

a plurality of zones fabricated with slip-resistant and substantially high friction materials are provided along the inner side of the legs starting from portions of the same trousers that are provided as a protection of the groin, and extending down beyond the portions that are provided as a protection of the knees of the wearer; the plurality of zones gazing parts of a motorcycle by adhering thereto by preventing local formation of air vortices.

5. The sports trousers according to claim 4, characterized in that zones fabricated with slip-resistant and substantially high friction materials are provided along the inner side of the legs of the wearer, in correspondence of the calves thereof.

6. Sports suit according to claim 1, characterized in that said zones fabricated with slip-resistant and substantially high friction materials are provided in the form of strips of elastomeric material of various sizes and conformations, in which said strips are attached by means of ultrasonic welding, sewing, bonding or some other per se known method.

7. Sports suit according to claim 1, characterized in that said slip-resistant zones are fabricated with elastomeric material, such as for example nitrile rubber, in the mixture of which there is included an abrasive material, such as pumice.

8. Sports suit according to claim 7, characterized in that said zones are fabricated with elastomeric material, such as for example nitrile rubber and on the surface of said elastomeric material there is imprinted a particularly rough pattern.

9. Sports suit according to claim 1, characterized in that said zones are fabricated with a loop-and-hook material.

10. Sports suit according to claim 1, characterized in that, in correspondence of other parts of the body of the wearer differing from those involved by said zones which are in touch with or at least grim parts of a motor-cycle, zones of the outer surface thereof are fabricated with wear-resistant materials.

11. A sports suit for a motorcyclist, the sports suit comprising:

an exterior surface comprising a plurality of zones, the plurality of zones corresponding to and disposed over body areas of the motorcyclist which are in contact with a motorcycle when the motorcyclist takes a streamline riding position on the motorcycle;

each of the plurality of zones comprising a high friction material to retain contact with the motorcycle, thus, preventing local formation of air vortices.

* * * * *

UNITED STATES PATENT AND TRADEMARK OFFICE

CERTIFICATE OF CORRECTION

PATENT NO. : 7,117,537 B2
APPLICATION NO. : 10/399347
DATED : October 10, 2006
INVENTOR(S) : Gabriele Mazzarolo It is certified that error appears in the above-identified patent and that said Letters Patent is hereby corrected as shown below:

On the Title of the patent, item (75) should read as follows:

(75) Inventors: Giovanni Mazzarolo, Coste di Maser (IT)

Signed and Sealed this

Sixth Day of November, 2007

JON W. DUDAS
*Director of the United States Patent and Trademark Office*